US007520011B1

(12) United States Patent
Liberkowski

(10) Patent No.: US 7,520,011 B1
(45) Date of Patent: Apr. 21, 2009

(54) PATIENT BEDDING SYSTEM WITH DENSE MATRIX OR INDIVIDUALLY SUSPENDED DIRECTLY BODY SUPPORTING PINS

(76) Inventor: Janusz Liberkowski, 15975 Shannon Rd., Los Gatos, CA (US) 95032

( * ) Notice: Subject to any disclaimer, the term of this patent is extended or adjusted under 35 U.S.C. 154(b) by 121 days.

(21) Appl. No.: 11/743,582

(22) Filed: May 2, 2007

(51) Int. Cl.
*A47C 17/00* (2006.01)

(52) U.S. Cl. ..... 5/731; 5/729; 5/719; 5/937

(58) Field of Classification Search ..... 5/731, 5/729, 727, 722, 719, 936, 614, 613, 937
See application file for complete search history.

(56) References Cited

U.S. PATENT DOCUMENTS

| | | | | |
|---|---|---|---|---|
| 187,777 | A * | 2/1877 | Sargent | 5/600 |
| 2,112,702 | A * | 3/1938 | Loibl | 5/600 |
| 3,656,190 | A * | 4/1972 | Regan et al. | 5/613 |
| 4,134,168 | A * | 1/1979 | Guigan | 5/600 |
| 4,439,880 | A | 4/1984 | Koncelik et al. | |
| 5,142,719 | A | 9/1992 | Vrzalik | |
| 5,446,933 | A * | 9/1995 | Gabelhouse | 5/670 |
| 5,966,762 | A | 10/1999 | Wu | |
| 6,182,315 | B1 | 2/2001 | Lee | |
| 6,487,738 | B1 * | 12/2002 | Graebe | 5/719 |
| 6,493,888 | B1 | 12/2002 | Salvatini et al. | |
| 6,502,259 | B2 | 1/2003 | Chang | |
| 6,721,981 | B1 * | 4/2004 | Greenhalgh et al. | 5/716 |
| 6,829,797 | B2 * | 12/2004 | Partian | 5/713 |
| 7,069,610 | B1 | 7/2006 | Chai | |
| 2004/0231057 | A1 * | 11/2004 | Sabin | 5/716 |
| 2007/0095413 | A1 * | 5/2007 | Zhu et al. | 137/883 |

* cited by examiner

*Primary Examiner*—Jared J Fureman
*Assistant Examiner*—Brittany M Wilson
(74) *Attorney, Agent, or Firm*—IDEPA Inc.; Johannes Schneeberger

(57) ABSTRACT

A support pin matrix features a number of support pins densely two dimensionally arrayed and individually springily suspended such that a patient's body or body portions may be bedded directly on the support pins. The pins are preferably pressurized by a fluid pressure system for highly balanced contact pressure irrespective the individual pins' load deflection. A control system may provide a pin retraction wave of the support pins. A body resting surface accessing device may be moved across the support pin matrix and beneath a bedded patient in conjunction with the pin retraction wave. The resting surface accessing device may be configured for cleaning, drying, inspecting, irradiating, and/or massaging the body resting surface and/or for maintaining the body support pin matrix. A body carrying net may be retracted and raised in between the body support pins to lift the patient off the support pin matrix.

7 Claims, 6 Drawing Sheets

PATIENT BEDDING SYSTEM WITH DENSE MATRIX OR INDIVIDUALLY SUSPENDED DIRECTLY BODY SUPPORTING PINS

FIELD OF INVENTION

The present invention relates to bedding devices and systems for patients. In particular, the present invention relates to bedding devices and systems utilizing a matrix of individually suspended support pins.

BACKGROUND OF INVENTION

Bedding of immobilized patients is a challenging issue as is well known in the art. Particularly, the patient's resting surfaces are difficult to maintain in healthy conditions for long term immobilized patients. Lack of aeration, body fluid exposure, patient weight peak pressures and other well known issues threaten the effected skin areas to become sore. Therefore, there exists a need for a bedding device and system for long term bedding of immobilized patients that provides aeration, separation from body fluids and a balanced support of body weight avoiding patient weight peak pressures. The present invention addresses this need.

The transfer of immobilized patients off and onto the bed is also problematic, especially when the patient may need to be kept immobilized. Therefore, there exists a need for a bedding device that provides for a simple transfer of a patient substantially without moving the patient in its resting position. The present invention addresses also this need.

SUMMARY

A support pin matrix features a number of support pins densely two dimensionally arrayed and individually springily suspended such that a patient's body or body portions may be bedded directly on the support pins. The support pins are two dimensionally arrayed with a maximum pin spacing that is in a predetermined proportion to a support end diameter of the pins' support ends such that a weight pressure of the bedded patient is directly opposed by support pins and remains within predetermined limits irrespective of uneven contours of the resting surface. Through gaps between adjacent support pins aeration may be continuously provided to the resting surfaces.

The support ends may be of a soft material with a support end diameter such that adjacent support ends snugly contact and such that the weight pressure is reduced to levels similar to a continuous bedding surface. The pins are preferably pressurized by a fluid pressure device for highly balanced contact pressure irrespective the individual pins' load deflection. Balanced contact pressure together with reduced weight pressures result in substantially eliminated pressure peaks on the resting surface.

A control device may row wise and/or individually actuate the support pins. Row wise pin actuation may be in form of a pin retraction wave propagating across the support pin matrix. A resting surface accessing device may be moved across the support pin matrix and beneath a bedded patient in conjunction with the pin retraction wave. The resting surface accessing device may be configured for cleaning, drying, inspecting, irradiating, and/or massaging the resting surface and/or for maintaining the support pin matrix. Individual pin actuation may be utilized for tissue massaging and/or stimulation of blood circulation.

A carrying net has a mesh spacing and mesh positions that correspond to the support matrix such that the carrying net may be parked in between the raised support pins. The carrying net may be raised above the support ends of the support pins such that the weight is transferred onto the carrying net. In that way, an immobilized patient may be easily transferred off/onto the bedding device substantially without moving the patient in its resting position.

DETAILED DESCRIPTION

Figure 1:
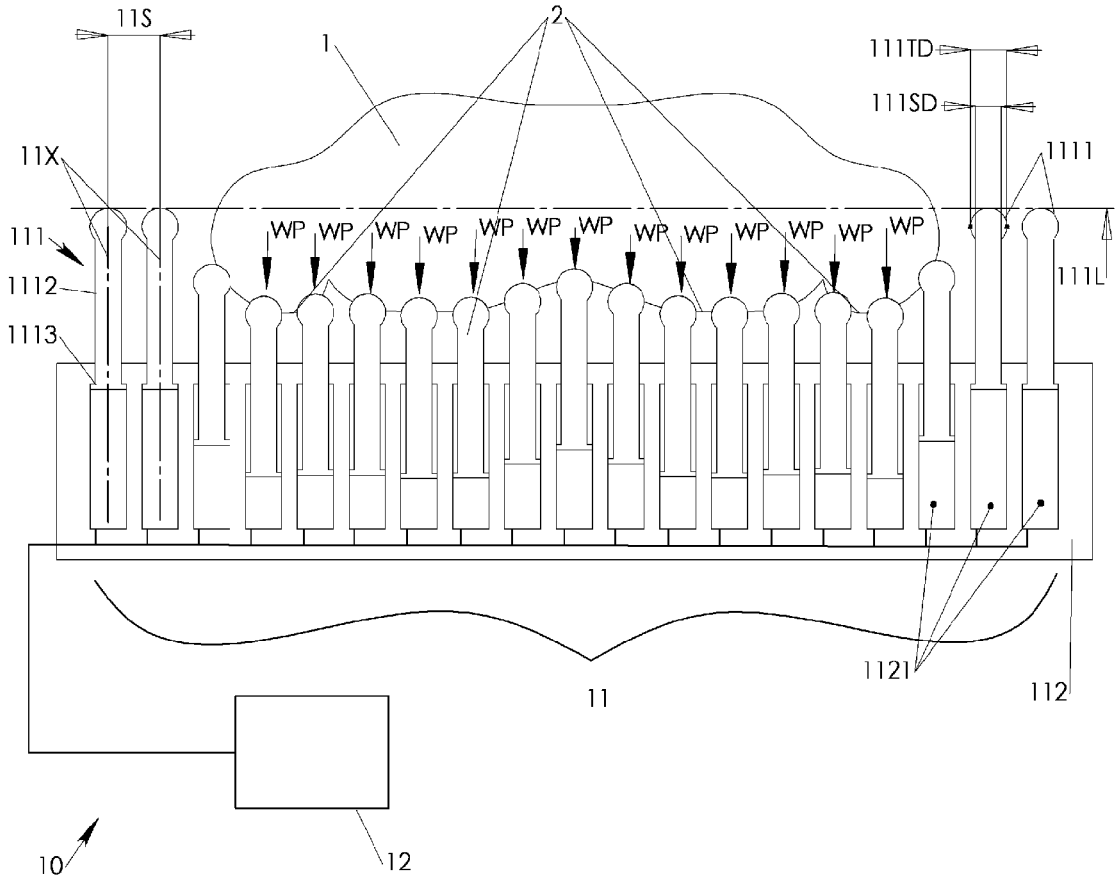
FIG. 1 is a frontal cross section view of a patient body bedded on a bedding device of the present invention.

Referring to FIG. 1, a patient bedding system 10 features a support pin matrix 11 that has a number of directly supporting support pins 111 two dimensionally arrayed and individually springily suspended such that weight pressures WP transmitted via resting surfaces 2 of a bedded patient 1 are directly and substantially evenly opposed irrespective of the resting surfaces' 2 curvature and configuration. Configuration and curvature of the resting surface 2 may vary along the patient's 1 body as may be well appreciated by anyone skilled in the art.

At least one but preferably each of the support pins 111 has a support end 1111 and a pin shaft 1112. The support ends 1111 are optionally of a soft material that has a softness of up to that of body tissue such that weight pressure WP causes the support end 1111 to resiliently deform and snugly contact the respective resting surface 2 area. The pin shaft 1112 is of a stiff material such that it may be linearly guided within guiding sleeves 1121 of a guiding matrix 112 as may be well appreciated by anyone skilled in the art.

The support pins are two dimensionally arrayed with a pin spacing 11S that is in a predetermined gap proportion to a support end diameter 111TD of the support ends 1111 such that the support pins 111 may directly oppose weight pressures WP of the patient 1 and such that the weight pressures WP are at predetermined levels. The larger the gap proportion, the higher the weight pressure WP for a given patient 1 weight and vice versa as may be well appreciated by anyone skilled in the art. In addition, the pin shaft diameter 111SD may also be substantially smaller than the support end diameter 111TD and the support end 1111 may have a dome shape. In that way, the predetermined gap proportion may be brought to a minimum between adjacent support ends 1111 may be kept to a minimum. At the same time, sufficient lateral separation between adjacent pin shafts 1112 is provided to meet structural requirements of the guiding matrix 112 as well as eventual space requirements for assembly of guiding sleeves 1121 as may be well appreciated by anyone skilled in the art. In case of employed soft material for the support end 1111, the support end diameter 111TD may be selected such that adjacent support ends 1111 laterally overlap and snugly contact. In such case, the gap proportion may be further reduced to zero. The gap proportion may be further adjusted in conjunction with aeration requirements to the resting surface 2 via the gaps in between the support ends 1111.

At least one but preferably each of the support pins 111 may have a displacement axis 11X along which the respective support pin 111 is individually springily suspended. Consequently, the respective support pins 111 may be resiliently displaced in correspondence with the resting surface 2 of the patient 1 while the weight pressures WP are directly opposed by the respective support pins 111.

Generally, the individual springely suspension of the support pins 111 may be provided by any well known means such as a connecting rod parallelogram or the like. Preferably, the individual springely suspension of the support pins 111 may be in a linearly guided fashion provided by a guiding matrix 112. The guiding matrix 112 may provide at least for one but preferably for all support pins 111 guiding sleeves 1121 defining the displacement axis 11X. The pin shafts 1112 extend inside the guiding sleeve 1121. At least one but preferably each pin shaft 1112 features a piston end 1113 opposite the support end 1111. The piston ends 1113 fit slide ably along the displacement axes 11X inside the respective guiding sleeves 1121 such that the individual springely suspension is substantially linear with respect to the displacement axes 11X. Piston ends 1113 may be configured in any suitable way as is known in the art.

The individual springely suspension of the support pins 111 may be generally accomplished by well known means such as mechanical springs or the like. Preferably, the guiding sleeves 1121 may be fluid pressurized guiding cylinders such as well known pneumatic guiding cylinders. At least two but preferably all fluid pressurized guiding cylinders may be in fluid communication with each other such that weight pressures WP experienced by each of the fluid communicating guiding cylinders is substantially equally opposed irrespective an individual deflection of each of the fluid communicating guiding cylinders. As a favorable result, weight pressure peaks in the interface between resting surface 2 and support ends 1111 may be substantially eliminated.

Further part of the patient bedding system 10 may be a control system 12, that controls at least one but preferably all support pins 111. The control system 12 may control displacement and/or spring load and/or fluid pressure in case of fluid pressurized guiding cylinders. By statically and/or dynamically modulating spring load and/or fluid pressure, the support pins 111 may be collectively and/or individually actuated. In that way, a massaging system may be part of the control system 12, providing a massaging of the resting surface 2 via a coordinated actuation of a number of support pins 111 within a predetermined massaging area of the support pin matrix 11. The massaging system may provide wavelike massaging patterns that correspond to predetermined blood flow directions beneath the respective resting surfaces 2. In that way, the massaging system may be configured for blood flow stimulation.

Figure 2:
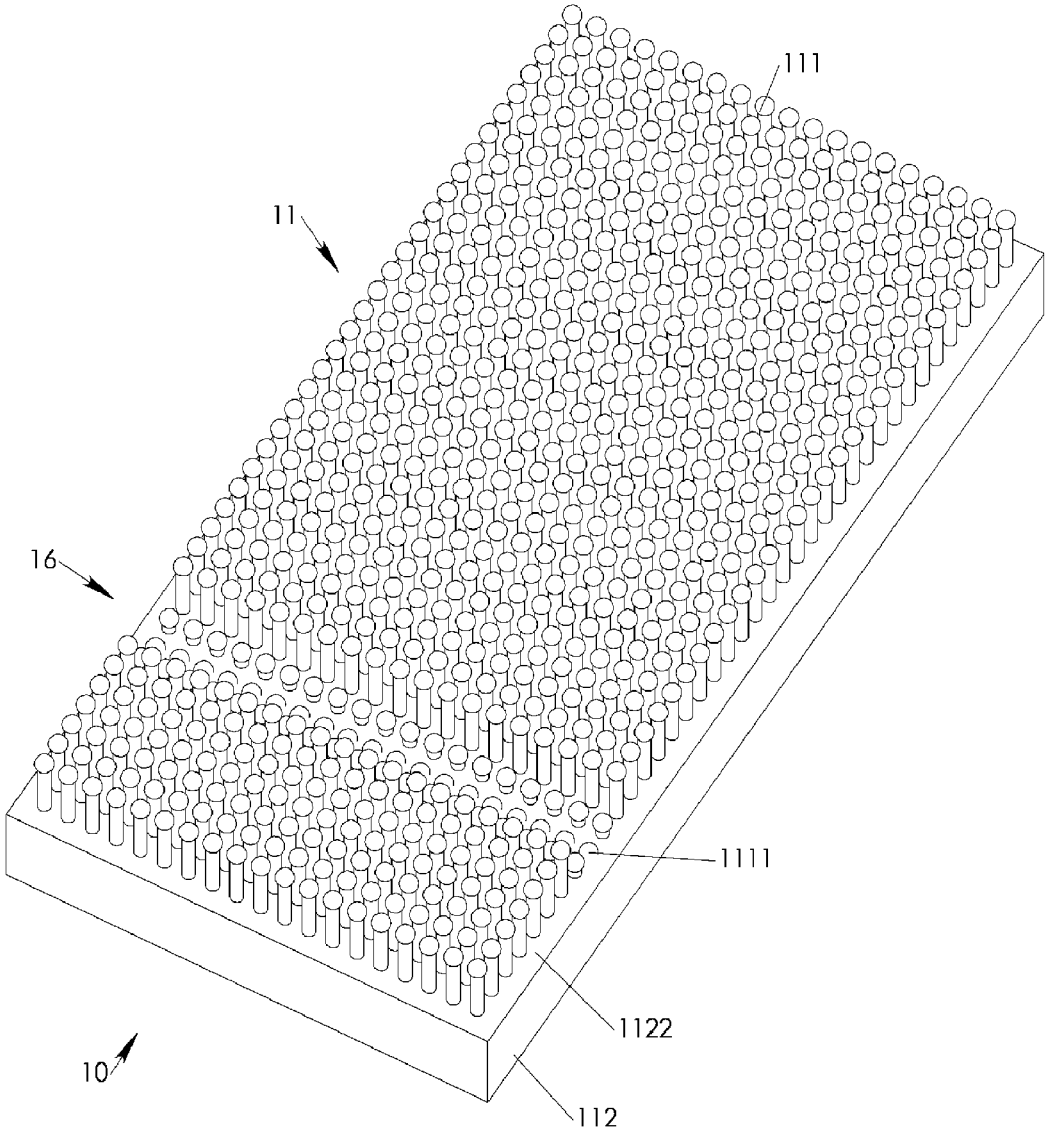
FIG. 2 is a first perspective view of a bedding device as in FIG. 1.
Figure 3:
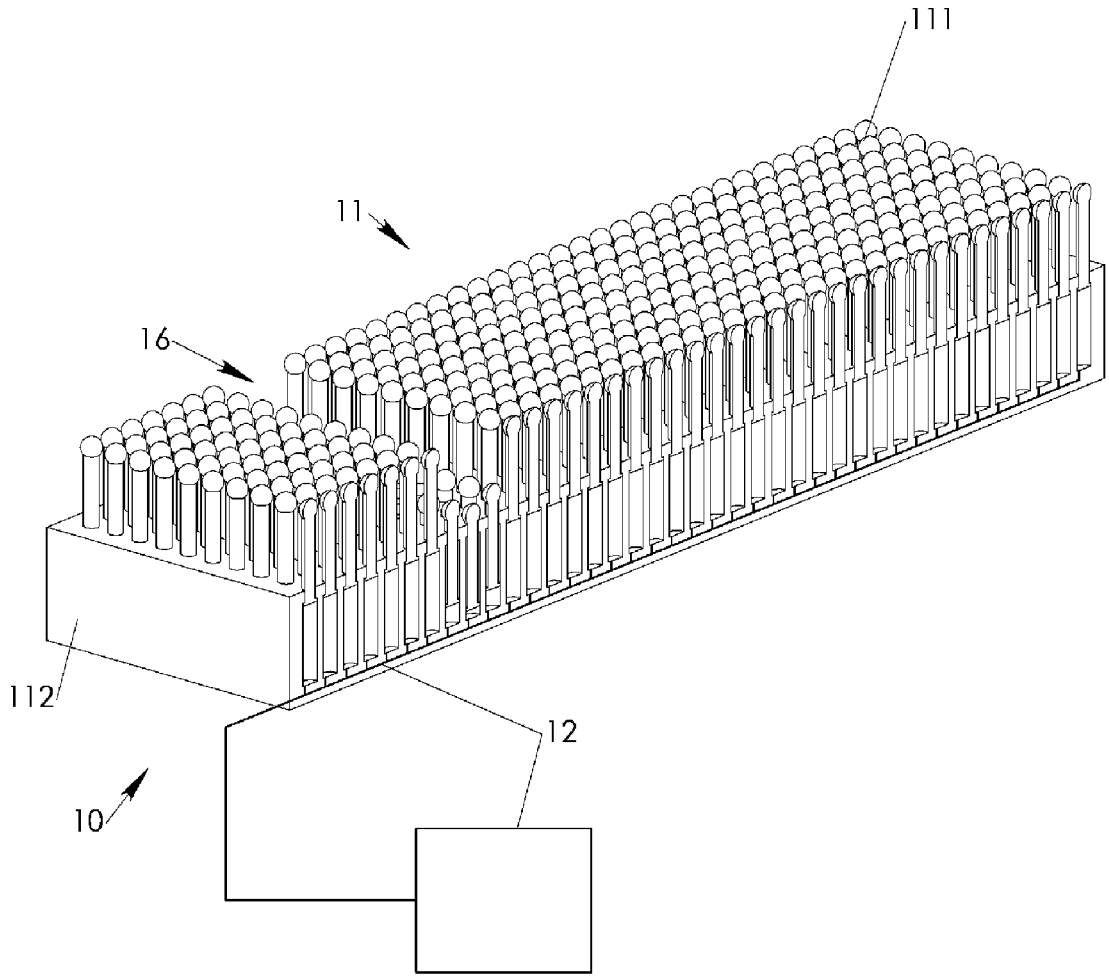
FIG. 3 is a second perspective view of a side cut bedding device as in FIGS. 1, 2.

Further referring to FIGS. 2 and 3, part of the control system 12 may also be a row wave pin retraction system that is row wise retracting the support pins 111 in a wave like fashion across the support pin matrix 11. The wave like retraction of support pin 111 rows may start at one side of the support pin matrix 11 by initially retracting a first row at the very outside of the support pin matrix 11. Once the first row is fully retracted or is in the process of being fully retracted, an adjacent second support pin 111 row is consecutively retracted. Once the second support pin 111 row is fully retracted or in the process of being retracted, a third support pin 111 row adjacent to the second support pin 111 row may be consecutively retracted, while the first support pin 111 row may be pressurized and/or spring loaded again forcing the respective support pins 111 into their load carrying extended position. As this process continues, a recess canyon 16 is formed within the support pin matrix 11. As support pin 111 rows are continuously recessed and again extended, the recess canyon 16 may propagate across the support pin matrix 11.

Figure 4:
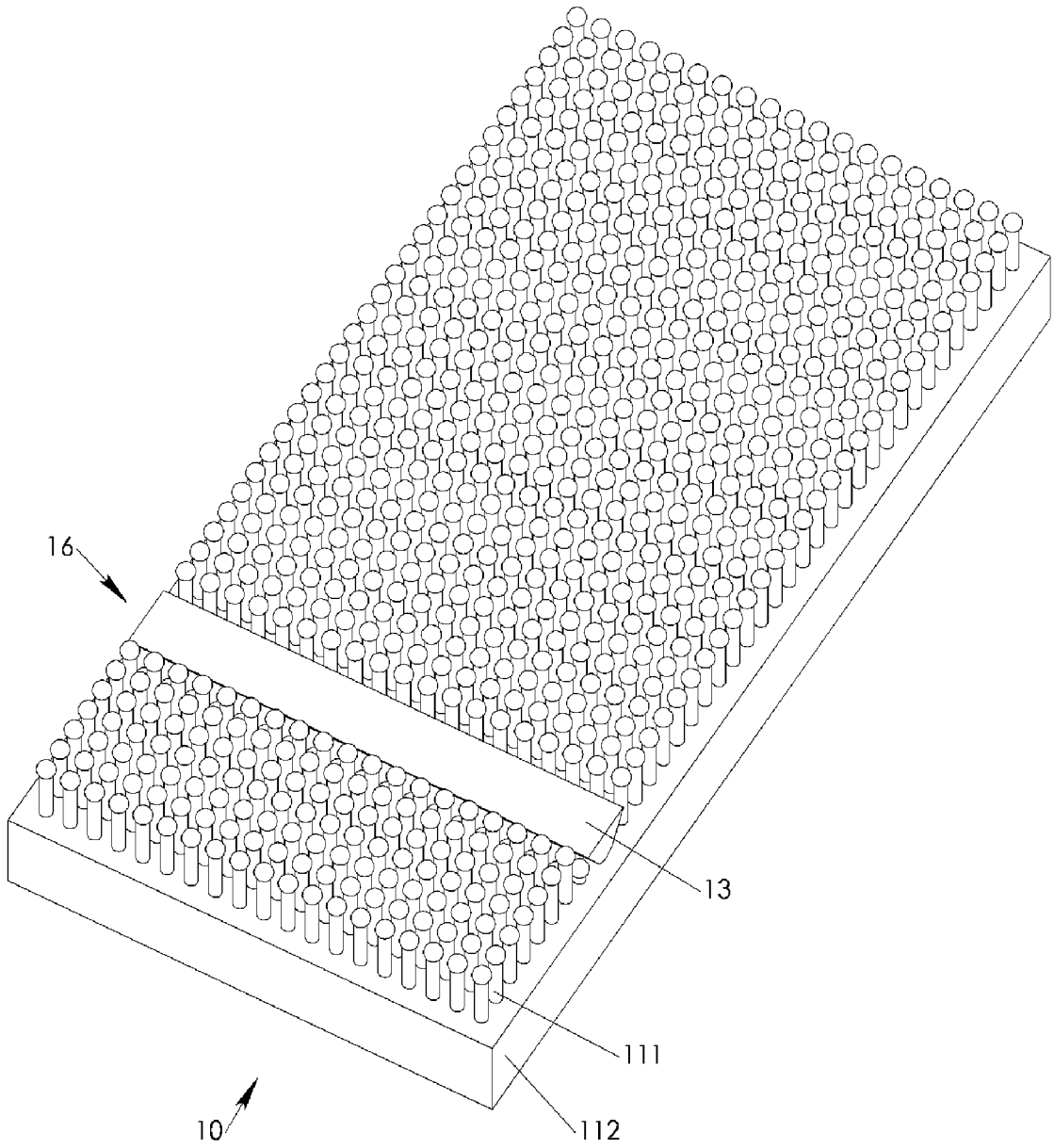
FIG. 4 is the first perspective view the bedding device of FIGS. 1-3 including a resting surface accessing device.

Referring to FIG. 4 and within that recess canyon 16, a resting surface accessing device 13 may be controlled moved across the support pin matrix 11 in conjunction with the row wise pin retraction wave. While the resting surface accessing device 13 is controlled moved across the support pin matrix 11 it remains with its cross section below a pin end extension limit 111L shown in FIG. 1. In that way, the resting surface accessing device 13 may be moved beneath the bedded patient 1. The top of the resting surface accessing device 13 may be optionally configured to partially support the resting surface in a contacting fashion, which may provide for an extended accessing of the resting surface 2 via the resting surfaces accessing device 13. The resting surface accessing device 13 may extend across the width of the support pin matrix 11 and be configured within the available space envelope to accomplish varying tasks.

The resting surface accessing device 13 may be a cleaning device for receiving and/or cleaning the patient 1 from bodily fluids and excrements. It may also be a drying device for drying the resting surface 2 after a wet cleaning procedure. The resting surface accessing device 13 may also be a resting surface inspection device in which an imaging device is moved beneath the resting surface 2 to image map the entire resting surface 2 or to obtain specific local images for visual inspection of the resting surface's 2 condition. The resting surface accessing device 13 may further be an irradiation device to provide for example natural light irradiation or other treatment irradiation to the resting surface 2. The resting surface accessing device 13 may also be a resting surface massaging device and/or a pin matrix maintenance device to clean and/or sanitize the elements of the support pin matrix 11 and/or the guiding matrix 112.

Figure 5:
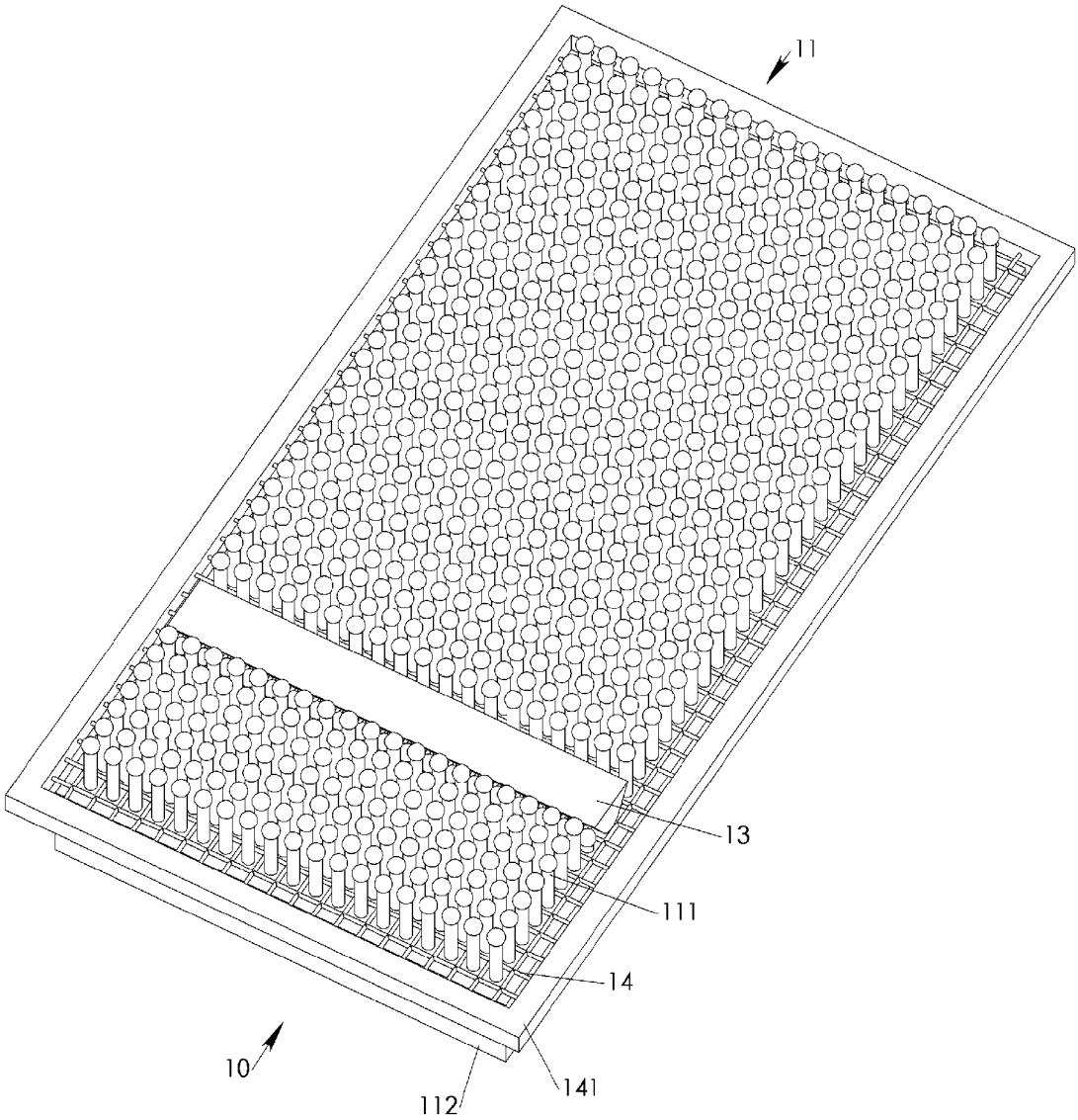
FIG. 5 is the first perspective view of the bedding device of FIGS. 1-4 including the resting surface accessing device of FIG. 4 and a carrying net in parked position.
Figure 6:
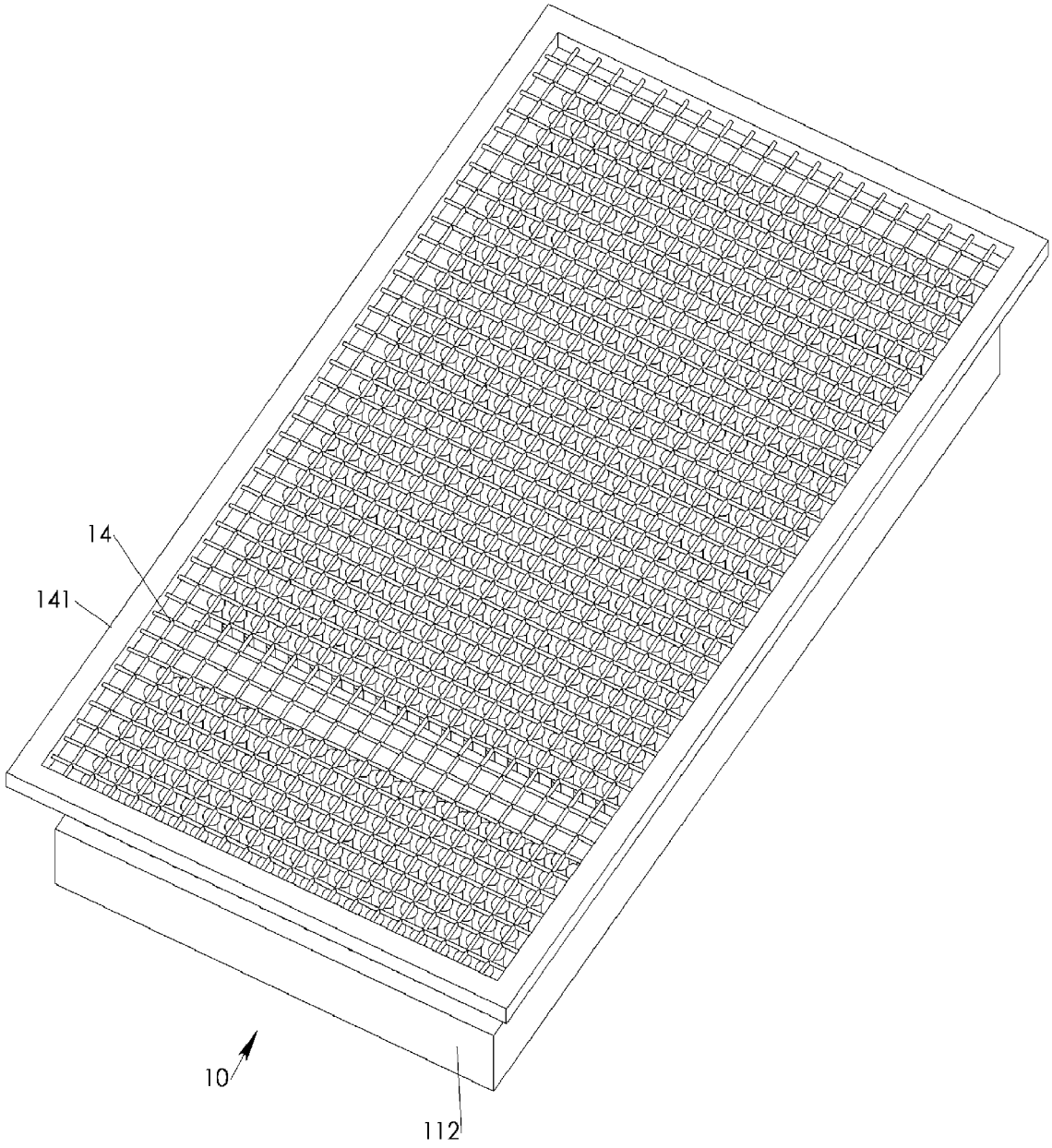
FIG. 6 is the first perspective view of the bedding device of FIGS. 1-4 including the resting surface accessing device of FIG. 4 and the carrying net in raised position.

Referring to FIGS. 5 and 6, the patient bedding system 10 of the present invention may additionally include a carrying net 14 that has a mesh spacing and mesh positions that correspond to support pin matrix 11 with its support pin 1111 positions and pin spacing 11S such that the carrying net may be retracted in between the support pins 111 in a parking position as shown in FIG. 5. While the carrying net 14 is moved above the pin end extension limit 111L, the weight pressures WP may be transferred from the support ends 1111 onto the carrying net 14 and the patient 1 lifted of the support pin matrix 11 as shown in FIG. 6. The patient 1 may be then transferred with the carrying net 14 onto a transportation device of otherwise manipulated. In the parking position, the carrying net 14 may also be cleaned and/or sanitized by the pin matrix maintenance device 13 as shown in FIG. 6. The carrying net 14 may be tensioned by and actuated via a surrounding frame 141. The carrying net 14 may provide for a simple and safe transfer of patients 1 that are required to be kept in an immobilized position during transfer.

Accordingly, the scope of the invention described in the specification and figures is set forth by the following claims and their legal equivalent.

What is claimed is:

1. A patient bedding system comprising:

a. a support pin matrix including a number of directly bedding support pins being two dimensionally arrayed and individually springily suspended;

b. a control system controlling at least one of a displacement, a spring load and a fluid pressure of at least one of said support pins, said control system comprising a row wave pin retraction system that is row wise retracting said number of support pins in a wave like fashion across said support pin matrix; and c. a resting surface accessing device that is controlled moved across said support pin matrix in conjunction with said row wise pin retraction wave, said resting surface accessing device having a cross section that is below a pin end extension limit while said resting surface accessing device is said controlled moved across said support pin matrix.

2. The patient bedding system of claim 1, wherein said resting surface accessing device is a resting surface cleaning device.

3. The patient bedding system of claim 1, wherein said resting surface accessing device is a resting surface drying device.

4. The patient bedding system of claim 1, wherein said resting surface accessing device is a resting surface inspection device.

5. The patient bedding system of claim 1, wherein said resting surface accessing device is a resting surface irradiation device.

6. The patient bedding system of claim 1, wherein said resting surface accessing device is a resting surface massaging device.

7. The patient bedding system of claim 1, wherein said resting surface accessing device is a pin matrix maintenance device.

* * * * *